US011313366B2

(12) United States Patent
Brandt et al.

(10) Patent No.: US 11,313,366 B2
(45) Date of Patent: Apr. 26, 2022

(54) DEVICE FOR CONVEYING A MEDIUM

(71) Applicant: ITT Bornemann GmbH, Obernkirchen (DE)

(72) Inventors: Jens-Uwe Brandt, Rinteln (DE); Marco Bredemeier, Niedernwoehren (DE); Joerg Lewerenz, Nienstaedt (DE)

(73) Assignee: ITT BORNEMANN GmbH, Obernkirchen (DE)

( * ) Notice: Subject to any disclaimer, the term of this patent is extended or adjusted under 35 U.S.C. 154(b) by 0 days.

(21) Appl. No.: 15/527,095

(22) PCT Filed: Nov. 19, 2015

(86) PCT No.: PCT/EP2015/077105

§ 371 (c)(1),
(2) Date: May 16, 2017

(87) PCT Pub. No.: WO2016/079239

PCT Pub. Date: May 26, 2016

(65) Prior Publication Data

US 2018/0291896 A1 Oct. 11, 2018

(30) Foreign Application Priority Data

Nov. 20, 2014 (DE) ..... 10 2014 017 072.1

(51) Int. Cl.
*F04C 2/16* (2006.01)
*F01C 1/16* (2006.01)
(Continued)

(52) U.S. Cl.
CPC ..... *F04C 2/16* (2013.01); *F01C 1/14* (2013.01); *F01C 1/16* (2013.01); *F04C 2/18* (2013.01);
(Continued)

(58) Field of Classification Search
CPC ..... F04C 11/003; F04C 18/16; F04C 11/001; F04C 2/16; F04C 2/18; F04C 15/008;
(Continued)

(56) References Cited

U.S. PATENT DOCUMENTS 1,433,733 A * 10/1922 Lindsay ..... F04C 11/003 184/31
1,702,838 A * 2/1929 Oliphant ..... F04C 11/003 417/338
(Continued)

FOREIGN PATENT DOCUMENTS

CN 103511249 A 1/2014
DE 19522551 A1 1/1997
(Continued)

OTHER PUBLICATIONS

Mexican Office Action dated Aug. 13, 2021 in corresponding Mexican Patent Application No. MX/a/2017/006514 (6 pages).

*Primary Examiner* — Peter J Bertheaud
(74) *Attorney, Agent, or Firm* — Carter, DeLuca & Farrell LLP; George Likourezos; Bret Shapiro

(57) ABSTRACT

The application relates to a device for conveying a medium having a working machine (2) and multiple carrier shafts (25, 35) with transport elements (22, 32) for the medium to be conveyed arranged on them, along a drive (3) that sets the carrier shafts (25, 35) in rotation, wherein the drive (3) has multiple driven shafts (20, 30), each of which is coupled with not less than one carrier shaft (25, 35).

17 Claims, 1 Drawing Sheet

(51) Int. Cl.

| | |
|---|---|
| ***F01C 1/14*** | (2006.01) |
| ***F04C 11/00*** | (2006.01) |
| ***F04C 18/16*** | (2006.01) |
| ***F04C 2/18*** | (2006.01) |
| ***F04C 15/00*** | (2006.01) |
| ***F04C 3/08*** | (2006.01) |

(52) U.S. Cl.
CPC ..... *F04C 11/001* (2013.01); *F04C 11/003* (2013.01); *F04C 15/008* (2013.01); *F04C 18/16* (2013.01); *F04C 3/08* (2013.01); *F04C 2240/30* (2013.01)

(58) Field of Classification Search
CPC ..... F04C 3/08; F04C 2240/30; E21B 43/129; F01C 1/14; F01C 1/16
See application file for complete search history.

(56) References Cited

U.S. PATENT DOCUMENTS 2,100,560 A * 11/1937 Kennedy ..... F04C 11/003 417/338
2,287,716 A 6/1942 Whitifield
2,750,891 A * 6/1956 Berry ..... F01C 1/123 418/7
2,910,948 A * 11/1959 Betzen ..... F04C 2/20 417/338
3,184,155 A 5/1965 Crooks
3,391,643 A * 7/1968 Zalis ..... F04C 15/0038 418/202
4,820,135 A * 4/1989 Simmons ..... E21B 43/129 417/391
4,828,036 A * 5/1989 Simmons ..... E21B 43/129 166/105.5
5,674,063 A 10/1997 Ozaki et al.
9,103,342 B2 8/2015 Jaeschke et al.

FOREIGN PATENT DOCUMENTS

| | | | |
|---|---|---|---|
| DE | 19522559 | A1 | 1/1997 |
| DE | 19856534 | A1 | 12/1998 |
| DE | 20305937 | U1 | 5/2004 |
| DE | 102008018407 | A1 | 10/2009 |
| DE | 102013021902 | A1 | 12/2013 |
| EP | 0937895 | A2 | 8/1999 |
| EP | 2048394 | B1 | 6/2007 |
| JP | H0858899 | A | 3/1996 |
| RU | 2498113 | C2 | 6/2009 |
| RU | 98497 | U1 | 5/2010 |

* cited by examiner

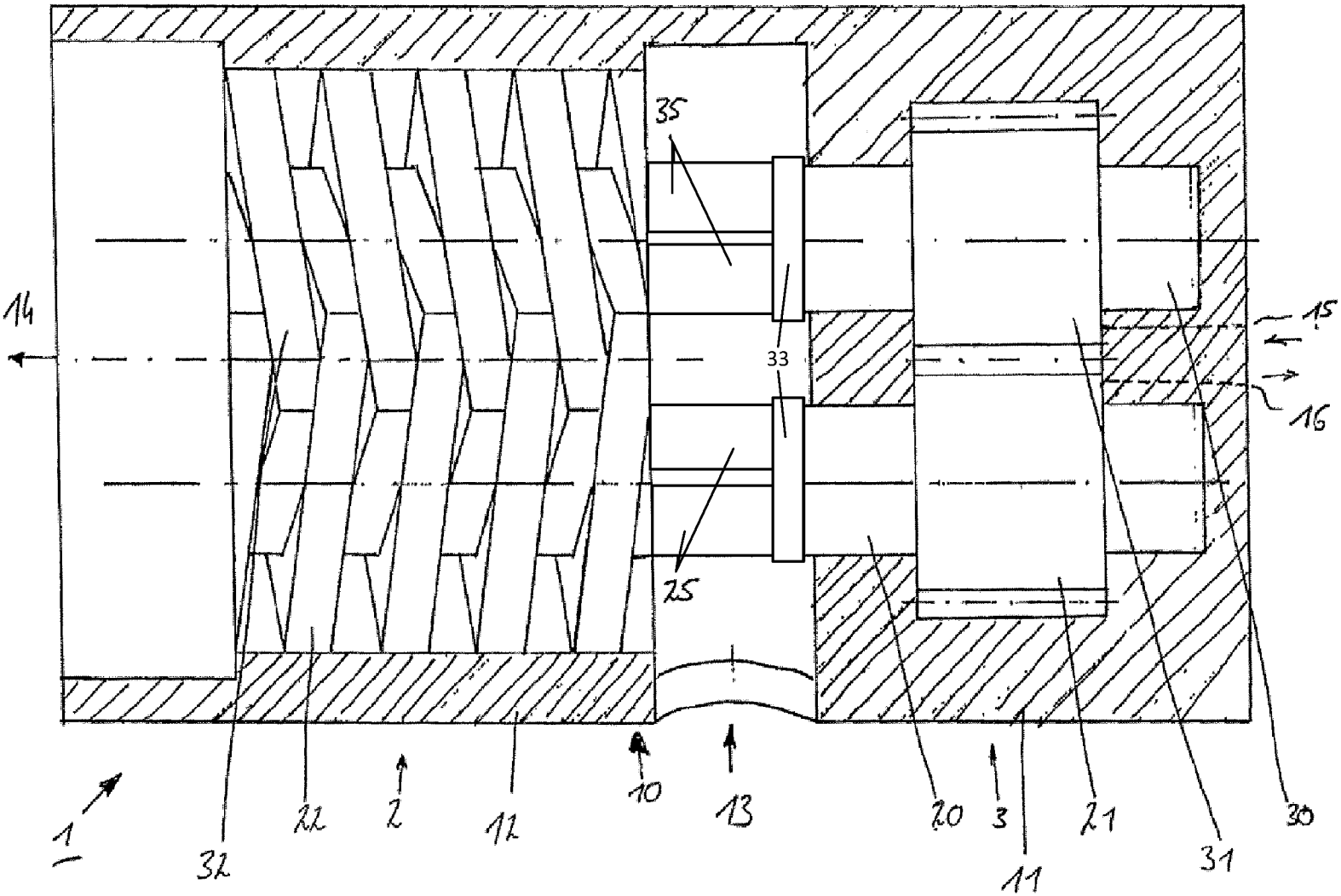
15
16
30
31
21
11
3
20
33
13
35
25
10
12
2
22
32
1
14

DEVICE FOR CONVEYING A MEDIUM

CROSS-REFERENCE TO RELATED APPLICATIONS

This application is a 371 of International Application No. PCT/EP2015/077105, filed Nov. 19, 2015 which claims priority to German Patent Application Number 10 2014 017 072.1, filed Nov. 20, 2014, the entirety of each disclosure is incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATED-BY-REFERENCE OF MATERIAL SUBMITTED ON A COMPACT DISC

Not Applicable

BACKGROUND

The invention relates to a device for conveying a medium having a working machine with multiple carrier shafts, on which transport elements for transporting the medium to be conveyed are arranged, and a drive that rotates the carrier shafts.

Working machines, e.g. displacement pumps with multiple shafts, are usually driven by a single drive, e.g. a hydraulic engine, internal combustion engine or an electric motor that is connected to the driven shaft of the working machine either directly or by means of a coupling. Such an embodiment with an electric motor is, for example, described in DE 10 2008 018 407 A1.

In case of working machines with multiple shafts that depend on the angle of rotation and function according to the positive displacement principle, a load distribution between the individual shafts is required, which creates additional high forces and bending moments within the machine. In addition to that, the shafts depending on the angle of rotation need to be synchronized

BRIEF SUMMARY OF THE INVENTION

The objective of the present invention is to provide a device that provides higher dependability and durability with similar dimensions or allows for a more compact design.

This objective is met according to the invention by means of a device with the characteristics of the main claim. Advantageous configurations and additional embodiments of the invention are disclosed in the dependent claims, the written description and in the FIGURE.

The device for conveying a medium having a working machine and multiple carrier shafts with transport elements for the medium to be conveyed arranged on them, along with a drive that sets the carrier shafts in rotation, is designed in such a way that the drive has multiple driven shafts, each of which is coupled with no less than one carrier shaft. The working machine, usually a pump, has two or more carrier shafts with transport elements, such as gears or screw spindles, arranged on them. A drive sets the carrier shafts in rotation, so that the medium to be conveyed is transported by the transport elements through the housing or conveying chamber from an inlet to an outlet. The drive has multiple driven shafts, each of which is coupled with no less than one carrier shaft. Each of the carrier shafts is coupled with a driven shaft so that each carrier shaft is driven individually. Instead of using a single-shaft drive to drive a multi-shaft working machine over a single drive spigot along with a respective coupling element for synchronizing the respective carrier shafts, the drive according to the invention is realized through multiple driven shafts that drive the individual angle-dependent shafts of the working machine, wherein preferably the proportionate drive torque is evenly induced into every individual carrier shaft. Thus, the conveyance of a drive torque through the driven shaft into the other driven shafts is avoided, which leads to significantly reduced torsional moments and bending moments.

In a preferred configuration, the number of driven shafts of the drive corresponds to the number of carrier shafts, so that every carrier shaft is driven by exactly one driven shaft of the drive. By reducing the conveyed loads and by evenly distributing the loads in the shafts of a working machine, the expected lifespan can be significantly increased, and in turn, the dimensions of the shafts, bearings and seals can be reduced respectively.

The carrier shafts of the working machine may be coupled with each other in an angle-dependent and rigid way, in order to ensure synchronization and a correct roll-off process of meshing transport elements, such as screw spindles or gears. This results in reduced wear of the transport elements and in prolonged maintenance intervals. Relative twisting of the transport elements in relation to each other is no longer possible, an axial displacement possibility in assembled state is not provided, or only to a small degree, e.g. in order to balance out bearing tolerances.

The working machine is preferably designed as a displacement pump, in particular a screw spindle pump, which makes it possible to realize very compact working and driving machine units that can be advantageously used under restricted spacial conditions, such as those found, for example, on oil production and gas extraction platforms.

The drive is preferably designed as a hydraulic engine, which enables a space-saving construction, especially when conveying fluids. Usually, there is hydraulic driving power provided, so that a compact, low-maintenance and simple drive system can be realized.

If the drive is designed as a hydraulic gear motor or screw spindle motor, it has the advantage that the gear or screw spindle components of the drive can simultaneously be used for synchronizing the drives of the carrier shafts, which means that no further pair of gears is needed in order to ensure synchronicity of the carrier shafts. The function of a synchronizing gear is integrally performed by the hydraulic engine. The hydraulic engine may have two or more driven shafts, so that even in case of multi-shaft working machines, every carrier shaft can be coupled with a driven shaft.

To further increase the compactness of the device, the driven shafts may be part of the carrier shafts or be coupled with them in a torsionally rigid manner. It is possible to design the carrier shaft and the corresponding driven shaft in one piece, so that the shafts are firmly bonded with each other. Likewise, the shafts can be coupled by means of a coupling device such as a claw coupling, a screw connection, a connector or a gear drive. The gear drive requires more of a technological effort compared to the other solutions, but it enables a change of rotational speed and/or the direction of rotation of the working machine. The working machine and the drive may be located together in a single housing in order to enhance the compactness of the device.

In a preferred arrangement, the drive and the working machine are hydraulically separated from each other, so that the medium to be conveyed is not mixed with the driving medium for the drive. This reduces the risk of pollution of the drive unit and, in case of an embodiment of the drive unit as a hydraulic engine, the risk of pollution of the hydraulic fluid. By that, the wear of the drive unit is reduced and the overall durability of the device enhanced.

The solution according to the invention enables an automatic load distribution between the individual shafts of a multi-shaft working machine according to the positive displacement principle with a dependent angular position of the shafts. The carrier shafts are automatically synchronized by the drive. The individual impacting of the respective carrier shaft with the drive torque reduces or eliminates disturbing additional loads such as bending moments resulting from gear tooth forces, or torsion forces that are caused by the transmission of the driving torques through one shaft onto the next. Minimizing the additional loads reduces bending of the shafts that often occurs with conventional drive concepts, which opens the possibility of further improving efficiency by reducing the inner tolerances. In addition to that, reduced load means higher durability and higher fault tolerance, e. g. against peak loads or contaminations.

BRIEF DESCRIPTION OF THE SEVERAL VIEWS OF THE DRAWINGS

One embodiment of the invention is described below with reference to the attached FIGURE. The FIGURE shows a schematic sectional view of a device with a working machine and a drive.

DETAILED DESCRIPTION OF THE INVENTION

In the sectional view of the FIGURE, the device 1 with a housing 10 is shown, in which a working machine 2 and a drive 3 are located. The working machine 2 is designed as a screw spindle pump with two spindles and is located in a working machine housing section 12 of the housing 10. The drive 3 is located in a drive housing section 11 of the housing 10 and is designed as a twin-shaft hydraulic gear motor in the depicted embodiment example.

In the housing 10 an inlet 13 for the medium to be conveyed is provided, through which the medium to be conveyed, such as hydrocarbons in oil production or gas extraction can find their way into the working machine 2. From the inlet 13, the medium to be conveyed is transported by means of the transport elements 12, 22 in the shape of worm threads through the working machine 2 to the outlet 14.

The transport elements 22, 32 are mounted on the carrier shafts 25, 35 or designed as an integral part of them, and they convey the medium from the inlet 13 to the outlet 14. The carrier shafts 25, 35 penetrate the inlet area behind the inlet 13 and extend into the drive housing 11, so that they can be coupled with the driven shafts of the drive 3 in a torsionally rigid manner.

The drive 3 is arranged in the drive housing section 11 in the form of a hydraulic gear motor that is supplied with a pressurized hydraulic fluid via an inlet channel 15. Through the inlet channel 15, the hydraulic fluid is supplied to the pair of gears in mesh consisting of the gears 21 and 31. The gears 21, 31 are firmly fastened on the driven shafts 20 and 30 of the drive 3, e.g. shrunk or positively mounted, for example by means of a parallel key or a tooth system. The hydraulic fluid that is supplied via the inlet channel 15 to the drive 3 sets the gears 21, 31, and thus the driven shafts 20, 30, in rotation. The depressurized hydraulic fluid is removed via the outlet channel 16.

Instead of the shown design involving a gear motor, the drive 3 can likewise be designed as a screw spindle motor, in which the gearing of the driving components is achieved via screw spindles instead of gear teeth. In the depicted embodiment, the inlet channel 15 is arranged on the front side of the device 1 and allows the hydraulic fluid to flow in basically parallel to the rotation axis of the driven shafts 20, 30. The removal of the hydraulic fluid through the outlet channel 16 happens likewise on the front side in the opposite direction, i. e. also coaxial to the rotation axis of the driven shafts 20, 30. Thus, a space-saving design as well as an easy supply and an easy removal of hydraulic fluid is achieved in a bore hole, drill pipes or in a conveying pipeline from one side.

In the shown embodiment example, the driven shafts 20, 30 are designed in one piece with the carrier shafts 25, 35, so that the power supplied by the hydraulic engine is directly transmitted by the driven shafts 20, 30 of the drive 3 onto the carrier shafts 25, 35 of the working machine 2. As an alternative to the single-piece design of the driven shafts and the carrier shafts 20, 30, 25, 35, it is likewise possible that the driven shafts 20, 30 are coupled by means of a coupling device 33, such as a screwed flange, a coupling bushing or another rigid connection. It is likewise possible to couple the driven shafts 20, 30 with the carrier shafts 25, 35 in such a way that the angular position of the shafts 20, 25, 30, 35 to each other is maintained, for example by means of a gearing with a gear drive.

Instead of the single-piece design of the housing 10, a design involving multiple parts is likewise possible, particularly in such a way, that the working machine housing 12 and the drive housing 11 are manufactured separately and attached to each other.

Provision may be made for the drive 3 and the working machine 2 to be hydraulically decoupled from each other, so that no medium to be conveyed may reach the drive 3 from the working machine 2 in order to avoid contamination and a corresponding higher wear of the drive. To that end, the opening for the driven shafts 20, 30 into the inlet area or suction area of the working machine 2 is sealed off, for example by means of labyrinth seals or shaft seals. However, if the device 1 is meant to be used for oil production, it may be advantageous for the hydraulic fluid to be compatible with the fluid to be conveyed, for example, to be appropriately reprocessed oil, as in such a case a possible leakage in the seal would not result in pollution of the medium to be conveyed.

Placing the drive 3 and the working machine 2 in one housing 10 makes it possible to have a compact, and in particular a cylindrical design. There is a possibility of arranging multiple devices 1 in a row, one behind the other, and connecting them mechanically, so as to form one module. Such a consecutive arrangement of devices 1 has the advantage that the medium that is conveyed from the working machine 2 through the outlet 14 may be transported through a connecting channel to the inlet 13 of a following device. The hydraulic fluid that is being used to drive the drive 3 can thereby be conveyed through the housing of the device 1.

In a different embodiment from the shown example, it is also possible that two working machines 2 are coupled with one drive 3, so that the driven shafts 20, 30 of the drive 3 protrude from the drive housing 11 in both directions and are arranged on both sides of the gears 21, 31. In such a way, an even more compact design of the device 1 is possible. Both working machines 2 connected to such a drive 3 can transport the medium to be conveyed in the same direction. Alternatively, opposed transport directions may likewise be achieved with such a drive.

The carrier shafts 25, 35 of the transport elements 22, 32 and/or the screw conveyors are rigidly coupled with each other in an angle-dependent way, wherein the coupling is achieved by the gears 21, 31 of the drive 3 due to the torsionally rigid connection between the driven shafts 20, 30 and the carrier shafts 25, 35. A further synchronization of the carrier shafts 25, 35 is not needed, conveyance of moments through one of the carrier shafts is not necessary, which leads to a massive reduction of the load created by torsion moments and bending moments inside the shafts. In order to achieve more precise synchronization characteristics and synchronicity of the carrier shafts 25, 35 and thus of the transport elements 22, 32, it is possible and planned to arrange one or more meshing pairs of gears on the carrier shafts 25, 35 in addition to the gears 21, 31 of the drive 3, in order to ensure synchronicity. However, no driving power is induced by these synchronization gears, instead, only a more precise synchronization is achieved. Ideally, the driving power of the drive 3 is induced evenly into both carrier shafts 25, 35, which is due to the direct coupling between the driven shafts 20, 30 and the carrier shafts 25, 35, which ensures that every carrier shaft 25, 35 is driven individually. Through the individual coupling of a carrier shaft 25, 35 with a driven shaft 20, 30 of the drive 3, an automatic distribution of the load onto the individual shafts of a multi-shaft working machine 2 with a dependent angular position of the carrier shafts 25, 35 follows, whereby, in an advantageous arrangement, the working machine 2 is working according to the positive displacement principle. All shafts are automatically synchronized with each other. By minimizing additional loads, such as e.g. bending moments that result from gear tooth forces or from the torsion due to the conveyance of drive torques from one shaft onto the next, the occurring bending of the shafts is reduced, which opens the possibility of improving the efficiency by reducing the inner tolerances within the transport elements.

The invention claimed is:

1. A device for conveying a medium, the device comprising:

a working machine, wherein the working machine includes multiple carrier shafts and the carrier shafts each include transport elements for the medium to be conveyed, wherein the transport elements are meshing transport elements;

a drive, wherein the drive is a hydraulic drive, the drive includes at least two driven shafts, each driven shaft is coupled with two or more carrier shafts, and each of the driven shafts is coupled with the carrier shafts in a torsionally rigid manner by a coupling device;

an inlet channel, wherein the inlet channel is arranged on a front side of the device and allows hydraulic fluid to flow into the device in a first direction parallel to a rotational axis of the at least two driven shafts; and an outlet channel, wherein the outlet channel is arranged on the front side of the device and allows the hydraulic fluid to be removed from the device in a second direction parallel to the rotational axis of the at least two driven shafts and opposite the first direction.

2. The device of claim 1, wherein the carrier shafts of the working machine are coupled with each other in an angle-dependent and rigid manner.

3. The device of claim 1, wherein the working machine is located in a working machine housing, the drive is located in a drive housing, and the working machine housing and the drive housing are manufactured separately and attached to each other.

4. The device of claim 1, wherein the working machine and the drive are located together in one housing.

5. The device of claim 1, wherein the drive and the working machine are hydraulically decoupled from each other.

6. The device of claim 1, wherein each coupling device is a screw flange.

7. The device of claim 1, wherein each coupling device is a coupling bushing.

8. The device of claim 1, wherein the driven shafts further include shaft seals to avoid contamination and wear of the drive.

9. The device of claim 1, wherein hydraulic fluid used for the hydraulic drive is compatible with the medium to be conveyed.

10. A device for conveying a medium, the device comprising:

a positive displacement screw spindle pump having multiple carrier shafts, each of the carrier shafts including meshing transport elements for the medium to be conveyed;

a drive including at least two driven shafts, each driven shaft being coupled with two or more carrier shafts in a torsionally rigid manner by a coupling device:

an inlet channel, wherein the inlet channel is arranged on a front side of the device and allows hydraulic fluid to flow into the device in a first direction parallel to a rotational axis of the at least two driven shafts; and an outlet channel, wherein the outlet channel is arranged on the front side of the device and allows the hydraulic fluid to be removed from the device in a second direction parallel to the rotational axis of the at least two driven shafts and opposite the first direction.

11. The device of claim 10, wherein the carrier shafts are coupled with each other in an angle-dependent and rigid manner.

12. The device of claim 10, wherein the positive displacement screw spindle pump is located in a working machine housing, the drive is located in a drive housing, and the working machine housing and the drive housing are manufactured separately and attached to each other.

13. The device of claim 10, wherein the positive displacement screw spindle pump and the drive are located together in one housing.

14. The device of claim 10, wherein each coupling device is a screw flange.

15. The device of claim 10, wherein each coupling device is a coupling bushing.

16. The device of claim 10, wherein the driven shafts further include shaft seals to avoid contamination and wear of the drive.

17. The device of claim 10, wherein the drive is designed as a screw spindle motor.

* * * * *